US011229287B2

(12) United States Patent
Nilsson

(10) Patent No.: US 11,229,287 B2
(45) Date of Patent: Jan. 25, 2022

(54) SHELF

(71) Applicant: Elfa International AB, Västervik (SE)

(72) Inventor: Peter Nilsson, Västervik (SE)

(73) Assignee: Elfa International AB, Västervik (SE)

( * ) Notice: Subject to any disclaimer, the term of this patent is extended or adjusted under 35 U.S.C. 154(b) by 0 days.

(21) Appl. No.: 16/610,903

(22) PCT Filed: Apr. 24, 2018

(86) PCT No.: PCT/EP2018/060470
§ 371 (c)(1),
(2) Date: Nov. 4, 2019

(87) PCT Pub. No.: WO2018/202481
PCT Pub. Date: Nov. 8, 2018

(65) Prior Publication Data

US 2020/0154887 A1 May 21, 2020

(30) Foreign Application Priority Data

May 5, 2017 (EP) ..... 17169791

(51) Int. Cl.
*A47B 96/02* (2006.01)
*A47B 45/00* (2006.01)

(52) U.S. Cl.
CPC ..... *A47B 96/021* (2013.01); *A47B 45/00* (2013.01)

(58) Field of Classification Search
CPC ..... A47B 96/02; A47B 96/021; A47B 45/00; A47B 57/581; A47B 55/02
See application file for complete search history.

(56) References Cited

U.S. PATENT DOCUMENTS 1,961,144 A 6/1934 Griffith
3,762,344 A * 10/1973 Chez ..... B65D 19/0026 108/57.29
4,299,637 A * 11/1981 Oberdeck ..... A63F 3/065 101/483
4,513,551 A * 4/1985 Gauffin ..... E04B 2/789 52/364
5,460,103 A * 10/1995 Dunn ..... B65D 19/0018 108/57.18

(Continued)

FOREIGN PATENT DOCUMENTS

CA 2638487 A1 2/2009
FR 2953696 A1 6/2011

(Continued)

OTHER PUBLICATIONS

European Office Action received in European Application No. 17169791.5, dated Jan. 28, 2020, 4 pages.

(Continued)

*Primary Examiner* — Daniel J Rohrhoff
(74) *Attorney, Agent, or Firm* — Hubbard Johnston, PLLC

(57) ABSTRACT

The present disclosure relates to a shelf (1) for a storage system. The shelf is made of sheet metal and, comprises a top surface including an area with an expanded metal mesh panel. The shelf further comprises at least one unexpanded area (7) in between two expanded areas, along the length of shelf. This facilitates the attachment of reinforcement structures to the shelf which provides for a shelf capable of carrying a greater load.

14 Claims, 2 Drawing Sheets

(56) References Cited

U.S. PATENT DOCUMENTS

| | | | | | |
|---|---|---|---|---|---|
| 5,778,626 | A * | 7/1998 | Hellsten | E04C 3/07 | 52/844 |
| 6,050,048 | A * | 4/2000 | Hellsten | E04C 3/083 | 52/670 |
| 6,205,740 | B1 * | 3/2001 | Ekerholm | E04C 3/09 | 52/846 |
| 6,330,777 | B1 * | 12/2001 | Padley | B21D 47/04 | 108/51.11 |
| 7,228,985 | B2 * | 6/2007 | Yeh | B62D 25/084 | 220/485 |
| 7,257,932 | B2 * | 8/2007 | Ng | E04C 3/07 | 138/168 |
| 8,141,737 | B1 * | 3/2012 | Tsai | B65D 7/14 | 220/485 |
| 8,146,218 | B1 * | 4/2012 | Ealer, Sr. | E04D 13/076 | 29/6.1 |
| 8,234,836 | B2 * | 8/2012 | Anderson | E04C 3/09 | 52/843 |
| 8,763,347 | B2 * | 7/2014 | Anderson | B21D 47/02 | 52/846 |
| 8,826,898 | B2 * | 9/2014 | Armstrong | F24C 15/16 | 126/19 R |
| 9,687,124 | B1 * | 6/2017 | Riggs, Jr. | A47K 10/38 | |
| 9,782,996 | B1 * | 10/2017 | Kuo | B42F 7/12 | |
| 9,854,906 | B1 * | 1/2018 | Ke | A47B 47/0091 | |
| 9,987,876 | B1 * | 6/2018 | Tuang | B42F 7/12 | |
| 10,674,817 | B1 * | 6/2020 | Cao | A47B 55/02 | |
| 2001/0052310 | A1 * | 12/2001 | McIntyre | A47F 5/04 | 108/92 |
| 2003/0094124 | A1 * | 5/2003 | Wishart | B65D 19/38 | 108/51.11 |
| 2009/0045201 | A1 * | 2/2009 | Cheng | B65D 7/20 | 220/494 |
| 2010/0300993 | A1 * | 12/2010 | Ho | A47B 96/02 | 211/13.1 |
| 2011/0042336 | A1 | 2/2011 | Cheng et al. | | |
| 2016/0183682 | A1 * | 6/2016 | Tang | A47B 96/021 | 211/134 |

FOREIGN PATENT DOCUMENTS

| | | | |
|---|---|---|---|
| GB | 910304 | A | 11/1962 |
| JP | S5752943 | U | 3/1982 |
| RU | 162926 | U1 | 6/2016 |
| RU | 168646 | U1 | 2/2017 |

OTHER PUBLICATIONS

International Search Report and Written Opinion received in Patent Cooperation Treaty Application No. PCT/EP2018/060470, dated May 16, 2018, 7 pages.

Communication pursuant to Article 94(3) issued in European Application No. 17169791.5, dated Jun. 11, 2021.

Office Action issued in corresponding Russian Application No. 2019136362, dated Jul. 2, 2021.

СЕТКА ЦЕЛЬНОМЕТ АЛЛИЧЕСКАЯ ПРОСЕЧНО ВЫТЯЖНАЯ Стандарт организации СТО 57398459-31-2008 (СТп/пп/31), PR3aHb, 2009, retrieved Aug. 11, 2021 from http://www.proflist.ru/techinfo/STP_PP_31_1.pdf ("All-Metal Expanded Mesh: Organization Standard STO 57398459-31-2008 (STP/PP/31}"; Ryazan, 2009 believed to be an English language counterpart).

* cited by examiner

SHELF

RELATED APPLICATION

This application, a national phase application of PCT/EP2018/060470, filed Apr. 24, 2018, which claims priority to European Application No. 17169791.5 filed May 5, 2017.

FIELD OF THE INVENTION

The present disclosure relates to a shelf for a storage system, wherein the shelf comprises a top surface including an area with an expanded metal mesh panel.

TECHNICAL BACKGROUND

Such a shelf is shown in CA-2638487. The expanded mesh panel may be obtained by cutting a large number of parallel slits in a sheet metal piece and subsequently expanding the piece perpendicularly to the slits. The expanded piece may then be given a surface treatment such as powder coating to provide a desired color, and cover burrs etc. formed in the expanding process. One advantage with having an expanded metal mesh panel on a shelf top surface is that the surface becomes relatively skid free as compared to a smooth sheet metal surface. Further, the surface becomes ventilated to some extent.

One problem with shelfs of the above-mentioned type is how to make them more versatile.

SUMMARY OF THE INVENTION

One object of the present disclosure is therefore to provide a more versatile shelf. This object is achieved by a shelf as defined in claim 1. More specifically, in a shelf of the initially mentioned kind, the shelf comprises at least one unexpanded area in between two expanded areas, along the width of the shelf. This means that an area in between the sheet metal edges, at which the piece is stretched, is smooth and lends itself well to applying different reinforcement measures. For instance, the unexpanded area can be spot welded to a reinforcement bracket or beam. Thanks to such measures, the shelf becomes stronger and better suited to carry heavy loads. Therefore, the shelf becomes more versatile.

An unexpanded area may be arranged centred along the shelf, dividing the shelf in two, for instance equal areas of expanded metal mesh, and the shelf may further comprise a reinforcement, which is arranged at a bottom side of the shelf. By allowing attachment of a reinforcement at or close to the mid-point of the depth of the shelf, the shelf becomes stronger and capable of carrying a greater load.

The reinforcement may be provided as a beam bent to form a U-shape in cross-section. This achieves an increased second area of moment at the unexpanded location.

The reinforcement may have flanges adapted to be connected to the unexpanded area at the lower surface thereof, which facilitates using spot-welding or other fastening arrangements for attaching the reinforcement at the unexpanded area.

The reinforcement at the bottom surface of the shelf may extend along the length of the unexpanded area, preferably at least along most of the length thereof.

The shelf may further comprise unexpanded areas along the front and rear edges of the shelf. Such unexpanded areas may be bent out of the plane of the top surface to provide a stronger shelf.

Side pieces may be fitted to the edges perpendicular to the unexpanded areas.

DETAILED DESCRIPTION

The present disclosure relates to a mesh shelf being formed partly by expanded sheet metal. A main piece of such a shelf is shown in FIG. 1.

A piece of sheet metal is provided with a great number of small, parallel slits, running in successive parallel rows, by punching. The locations of the slits are offset between adjacent rows, usually such that the mid-point of a slit in one row is located at the interval in between two adjacent slits in the other. Every second row may therefore be in-phase with each other. Once the slits are punched in a desired pattern, the sheet metal piece is drawn in a direction perpendicular to the slits, expanding the piece and forming a rhombus-shaped small opening at the location of each slit.

Figure 1:
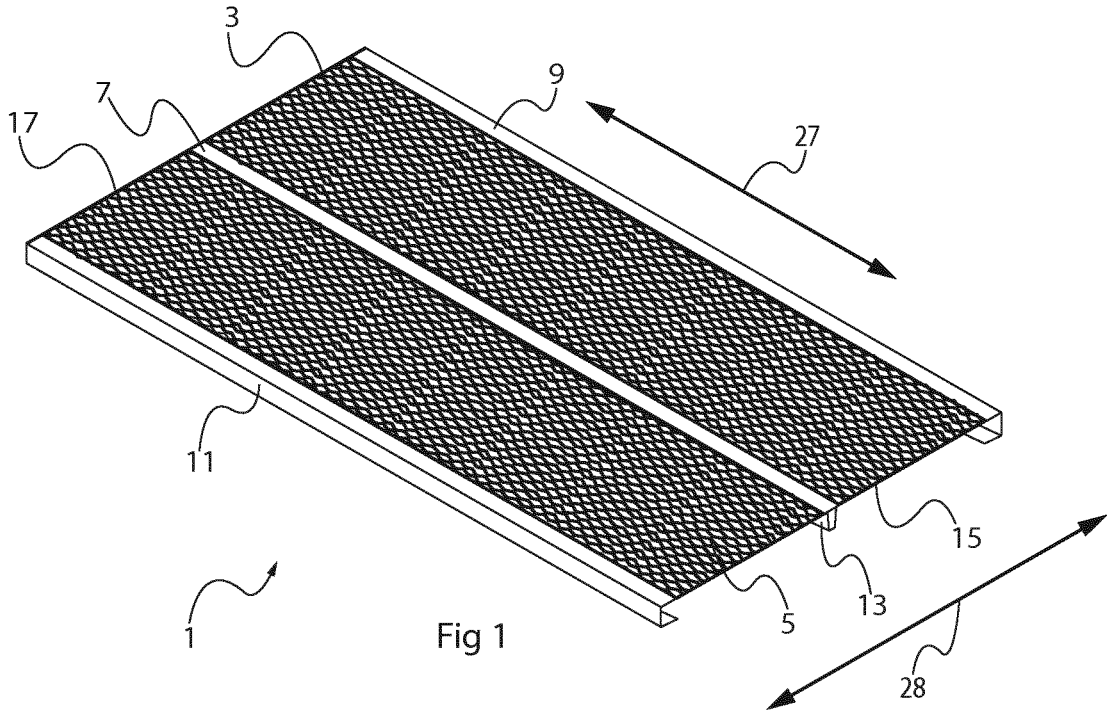
FIG. 1 shows a perspective view of a main part of a mesh shelf.

In the shown example of FIG. 1, a rectangular piece of sheet metal is used, which may have a thickness in the range 0.4-2.0 mm, typically 0.8 mm, and may comprise steel or possibly e.g. aluminum. The sheet metal is provided with slits in the above manner in two wide bands along the piece and is expanded to correspondingly form two expanded portions 3, 5. In between those portions 3, 5, an unexpanded portion 7 is maintained therebetween. This is done simply by not punching slits in that portion. Likewise, the edge portions 9, 11 are left unexpanded.

Thanks to the unexpanded portion 7, which in the illustrated case is located in the middle of the shelf 1, a reinforcement 13 may be provided under the unexpanded portion 7, as will be illustrated in more detail. The unexpanded portion 7 provides a smooth and flat sheet metal surface to which a reinforcement may for instance be spot welded, a process which would be significantly more difficult had the shelf 1 been expanded at that location. Other ways of attaching reinforcements such as soldering or gluing could be considered and also benefits from being able to attach to a smooth surface. The unexpanded portion 7 may in the same way be connected to a side piece 29 (cf. FIG. 4), which will be described in more detail. Therefore, the unexpanded portion 7 allows making a mesh board stronger, making it capable of carrying a greater load.

Providing more expanded and unexpanded areas on a board is possible as will be described.

Although the shelf 1 may in principle be square, usually, the shelf will have a main direction of extension 27 where it has its longest extension, as indicated in FIG. 1. The shelf main piece is usually expanded in the direction of the depth 28 of the shelf. Locating an unexpanded portion 7 at the mid-point of the shelf depth 28 may be preferred to provide an increased stiffness when the shelf is intended to be suspended between its short ends.

Figure 2:
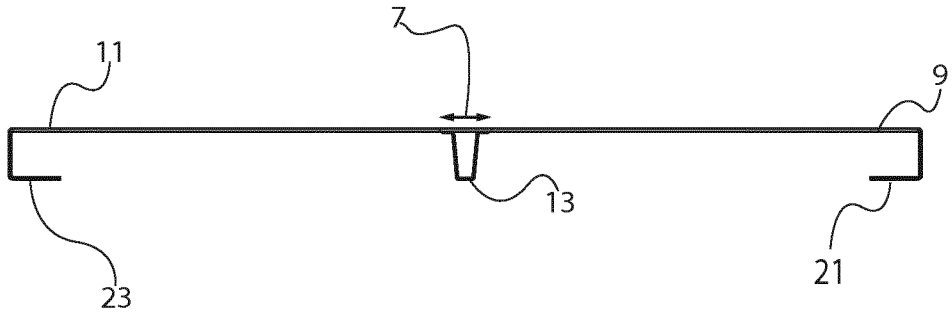
FIG. 2 shows a side view of the mesh shelf part of FIG. 1.
Figure 3:
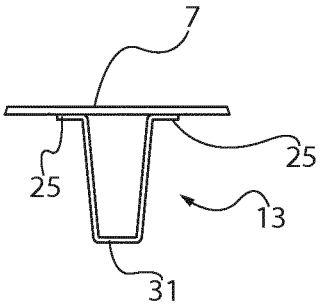
FIG. 3 shows an enlarged portion thereof.

FIG. 2 shows a side view of the mesh shelf of FIG. 1, and FIG. 3 shows an enlarged part thereof. As shown in FIG. 2, once the expansion has been carried out to accomplish the mesh structure, a reinforcement beam 13 may be attached on the lower face of the unexpanded portion 7. This may be done for instance by spot welding. Further, the edges 9, 11, that are parallel with the expanded mesh stripes 3, 5 and which may be unexpanded as well, may be bent to provide U-shaped cross sections 21, 23. This makes the shelf more stable by providing a significant second moment of area as compared to a flat structure, and together with the reinforcement beam 13 in between those edges makes the shelf capable of carrying a substantial load even if being made up by a relatively thin sheet material. The U-shape will not expose any, potentially sharp, sheet metal edges as the outer long edges of the shelf. Needless to say, the edges 9, 11 may be bent in other ways.

FIG. 3 illustrates the attachment of the reinforcement beam 13 on the lower surface of the unexpanded portion 7. As shown, the reinforcement beam 13 may comprise flanges 25 at its side edges which may be parallel with each other. Those flanges 25 may rest on the unexpanded surface 7 when being attached and therefore provide a good connection to this surface allowing a reliable connection thereto. The flanges may be attached to the unexpanded portion with spot welds at a number of locations along the length of the reinforcement flanges, although for instance a continuous weld or using a glue could be considered as other means for fastening the reinforcement beam. In between the flanges 25, an intermediate portion 31 extends out of the plane of the flanges 25. In the illustrated case, the intermediate portion 31 has the shape of a U or a truncated V with a flat bottom portion. Needless to say, other cross section shapes are conceivable where the intermediate portion extends out of the plane of the flanges 25 and provides an increased second area of moment. However, the illustrated shape may be well suited for serial production as will be shown, especially if the truncated bottom of the V-shape presents a surface at the same depth from the top surface of the shelf as does the U-shaped cross sections 21, 23 of the side edges. Reinforcement structures with other shapes such as for instance a rectangular tube may be considered, or the top surface itself can be bent to form a reinforcement structure.

Figure 4:
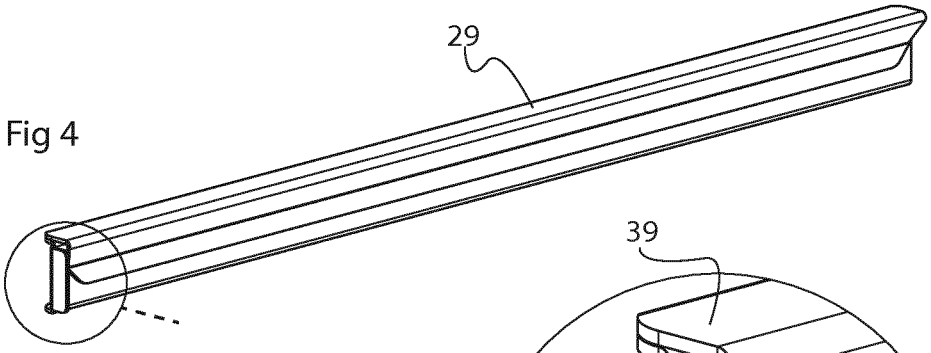
FIG. 4 shows a perspective view of an side edge piece for a mesh shelf.
Figure 5:
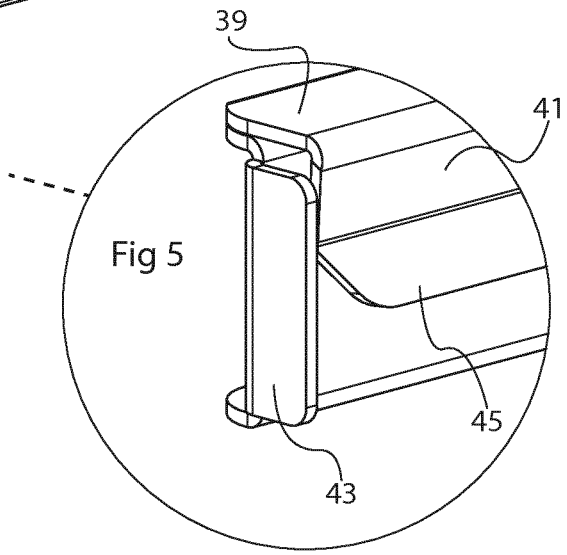
FIG. 5 shows an enlarged portion thereof.

FIG. 4 shows a perspective view of a side piece 29 for a mesh shelf, and FIG. 5 shows an enlarged portion thereof. Once the main shelf piece is formed as illustrated in FIGS. 1 and 2, such side pieces may be fitted on the main piece short edges 15, 17, or more generally, on the edges parallel to the direction in which the main piece is expanded. In principle, those edges could be long edges with a different geometry. Such side pieces could be used also together with non-expanded main shelf pieces.

Figure 6:
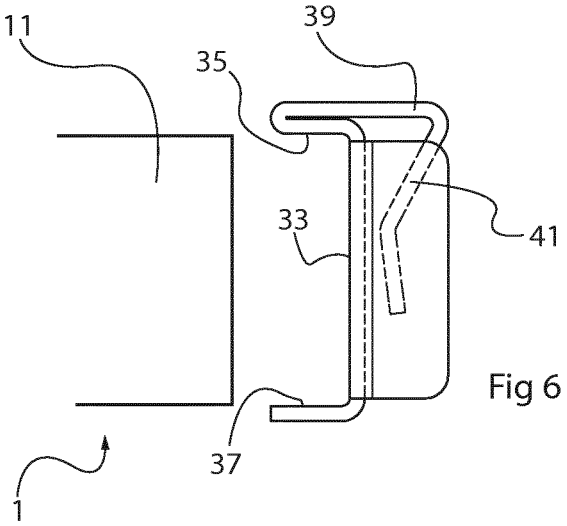
FIG. 6 shows a side view of the edge piece.

Although it is possible to provide each side piece as multiple parts, is advantageous to provide the side piece as a single piece of sheet metal which is bent into the configuration illustrated in FIGS. 4-6.

As shown in FIG. 6 each side piece comprises an inner part 33 with a C-shaped cross section presenting an upper, downward facing surface 35, and a lower, upward facing surface 37. The upper, downward facing surface 35 may be connected to the upper surfaces of the unexpanded main piece portion 7 and the edge portions 9, 11. A main piece of the shelf 1, being fitted in the C-shaped configuration of the side piece 29 as illustrated in FIG. 6, the main piece being seen from an edge portion 11. It is possible e.g. to spot weld the side piece 29 to the main piece at those locations. The lower, upward facing surface 37 may similarly be connected to the lower surfaces presented by the U-shaped cross sections 21, 23 bent at the long edges of the main piece, and to the bottom of the reinforcement beam 13. In addition to spot welding, other fastening techniques are conceivable such as continuous welding, soldering or gluing.

The side piece 29 may also comprise and outer part 39 that is bent from the inner part and presents a downwards directed flange 41. This flange 41, may be used to attach the shelf to a bracket (not shown) in order to suspend the shelf therefrom. Such brackets, presenting a U-shaped cross section to which the shelf may be attached, can be attached in a cantilevered fashion from a carrier element which is attached to a wall or the like, and are well known per se.

As illustrated, the side piece 29 may comprise a front tongue 43, which is folded over the end of the downwards directed flange 41 and prevents the flange from sliding in a bracket of the above-mentioned type. As shown, the lower 45 end of the downwards directed flange 41 may be angled slightly outwards to facilitate the fitting or the shelf in a bracket. Such side pieces 29, may be fitted to both short ends of the main piece to cover the ends of the expanded portions 3, 5, and to allow the shelf to be suspended from brackets or the like.

Figure 7A:
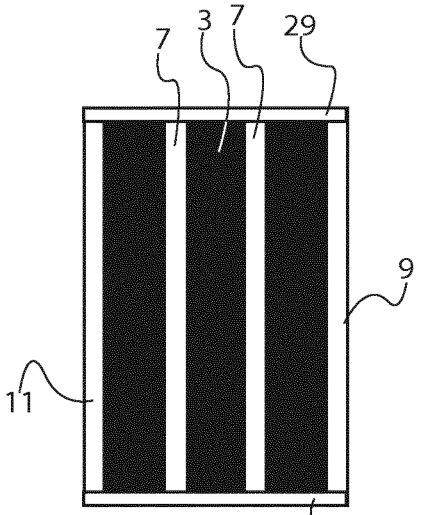
FIGS. 7*a* and 7*b* illustrate schematically other configurations of a mesh shelf surface.
Figure 7B:
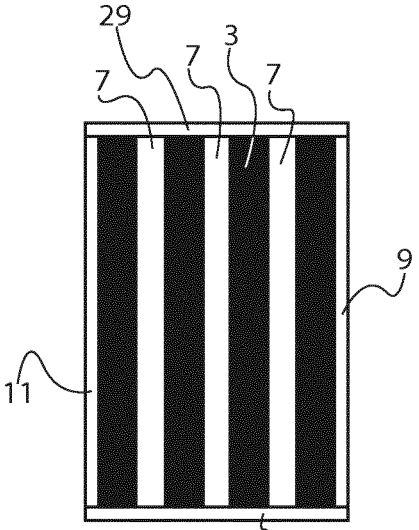

FIGS. 7*a* and 7*b* illustrate schematically other configurations of a mesh shelf surface. As illustrated, it is possible to provide more expanded areas 3 and more unexpanded areas 7 on a shelf top surface. FIG. 7*a* illustrates an example with two unexpanded areas 7 located at approximately ⅓ and ⅔ of the depth of the shelf, while FIG. 7*b* illustrates an example with three unexpanded areas located at approximately ¼, ½, and ¾ of the depth of the shelf. Reinforcements 13 (cf. FIG. 3) may be located beneath all or some of the unexpanded areas along their whole lengths or parts thereof. Expanded areas are located in between the unexpanded areas and run all the way from side piece 29 to side piece 29 as the main piece (cf. FIG. 1) is expanded across its whole surface to remain flat.

Needless to say, other configurations may be considered, and although the configurations in FIGS. 1, 7*a* and 7*b* are symmetrical with respect to the mid-point of the shelf's depth, this is not necessary.

The present disclosure is not restricted to the above examples, and may be varied and altered in different ways within the scope of the appended claims.

The invention claimed is:

1. A shelf for a storage system comprising a top surface, the top surface comprising a pane having at least one unexpanded area in between two expanded mesh areas along the shelf, and a reinforcement beam attached to a lower side of the at least one unexpanded area.

2. A shelf according to claim 1, wherein the reinforcement beam is provided by a beam bent to form, in cross-section, a U-shape, having a first and a second leg.

3. A shelf according to claim 1, wherein side pieces are fitted to the edges of the pane perpendicular to the unexpanded areas.

4. A shelf according to claim 1, wherein the reinforcement has flanges adapted to be connected to the unexpanded area at the lower surface thereof.

5. A shelf according to claim 1, wherein the shelf further comprises unexpanded areas along the front and rear edges of the shelf.

6. A shelf according to claim 5, wherein side pieces are fitted to front and rear edges of the shelf, perpendicular to the unexpanded areas.

7. A shelf for a storage system comprising a top surface, the top surface comprising a pane having an unexpanded area in between two expanded mesh areas along a length of the shelf; wherein the unexpanded area is centered between front and rear edges of the shelf with two, equal areas of expanded metal mesh on each side, and a U-shaped reinforcement that is attached to the unexpanded area at a lower surface thereof that extends along the length of the shelf.

8. A shelf according to claim 7, wherein the shelf further comprises unexpanded areas along the front and rear edges of the shelf.

9. A shelf according to claim 7, wherein side pieces are fitted to the front and back edges perpendicular to the unexpanded area.

10. A shelf according to claim 7, wherein the U-shaped reinforcement has flanges adapted to be connected to the unexpanded area at the lower surface thereof.

11. A shelf according to claim 7, wherein the shelf further comprises unexpanded areas along the front and rear edges of the shelf.

12. A shelf according to claim 11, wherein side pieces are fitted to the front and rear edges perpendicular to the unexpanded areas.

13. A shelf for a storage system comprising:

a top surface having at least one unexpanded area between two expanded mesh areas along a length of the shelf and unexpanded areas along the front and rear edges of the shelf;

side pieces are fitted to the front and rear edges perpendicular to the unexpanded areas; and a U-shaped beam under and attached to a lower surface of the at least one unexpanded area between the two expanded mesh areas and extending the length of the shelf.

14. A shelf according to claim 13, wherein the U-shaped beam comprises two legs and a flange depending from each leg, the flange being attached to the lower surface of the at least one unexpanded area between the two expanded mesh areas.

* * * * *